US005979546A

United States Patent [19]

Stolarski et al.

[11] Patent Number: 5,979,546

[45] Date of Patent: Nov. 9, 1999

[54] JOINT FOR A HEAT EXCHANGER ASSEMBLY

[75] Inventors: Donald Stolarski, Erie, Pa.; Thomas Powers, Chardon, Ohio; Steve Ringe, Westland, Mich.; Richard Nieno, Ashtabula, Ohio

[73] Assignee: Carlisle Engineered Products, Livonia, Mich.

[21] Appl. No.: 09/053,982

[22] Filed: Apr. 2, 1998

[51] Int. Cl.[6] ..... F28F 9/02

[52] U.S. Cl. ..... 165/173; 165/149; 165/DIG. 474

[58] Field of Search ..... 165/149, 167, 165/173

[56] References Cited

U.S. PATENT DOCUMENTS

| | | | |
|---|---|---|---|
| 3,450,200 | 6/1969 | Wright | 165/167 |
| 3,628,603 | 12/1971 | Fieni . | |
| 4,041,594 | 8/1977 | Chartet . | |
| 4,559,688 | 12/1985 | Abu-Isa et al. . | |
| 4,635,715 | 1/1987 | Andersson . | |
| 4,705,104 | 11/1987 | Potier . | |
| 4,905,758 | 3/1990 | Mathur et al. . | |
| 4,967,836 | 11/1990 | Nakamura . | |
| 5,160,474 | 11/1992 | Huff | 264/255 |
| 5,246,065 | 9/1993 | Huff | 165/173 |

FOREIGN PATENT DOCUMENTS

| | | | |
|---|---|---|---|
| 406774 | 1/1991 | European Pat. Off. | 165/173 |
| 1039911 | 10/1953 | France | 165/173 |
| 3833262 | 4/1990 | Germany | 165/173 |
| 147097 | 7/1986 | Japan | 165/173 |

*Primary Examiner*—Leonard Leo
*Attorney, Agent, or Firm*—Rader, Fishman & Grauer PLLC

[57] ABSTRACT

An improved end tank-to-header joint is disclosed. An end tank is formed with a flange portion that has at least one groove therein. A gasket having a predetermined cross-sectional shape is provided with at least one tongue portion that is adapted to engage the groove in an interference fit, thereby integrating the gasket with the end tank. A header is crimped to form a channel. The channel has a shape the corresponds to the shape of the gasket, such that the gasket is fully seated within the channel. A distal end of the header is then crimped around the flange of the end tank to ensure a fluid-tight seal at the joint.

6 Claims, 2 Drawing Sheets

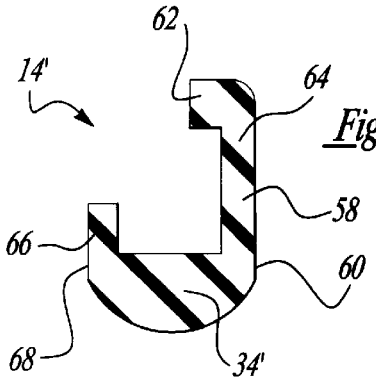
Fig-6
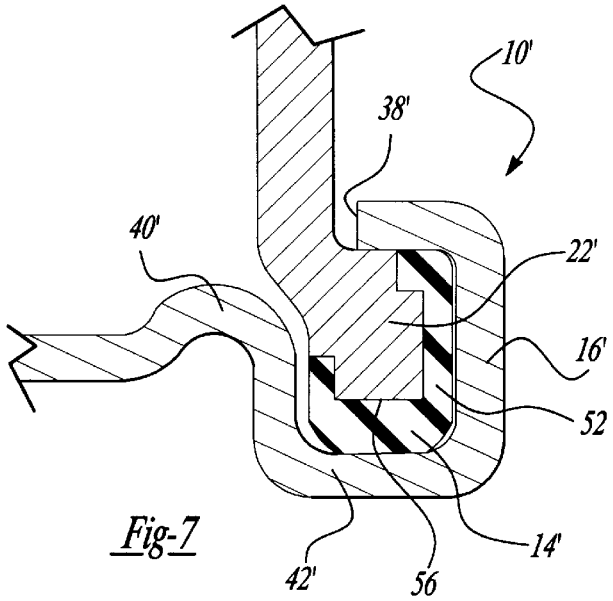
Fig-7
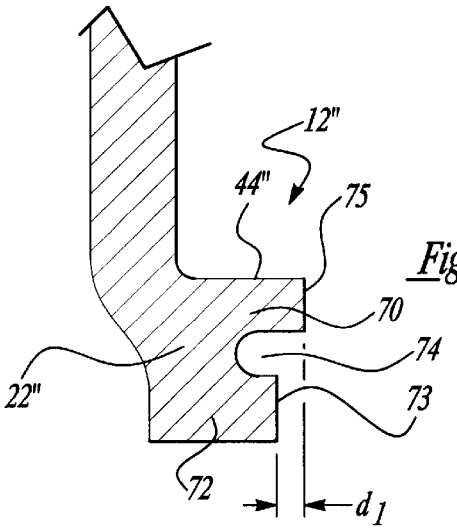
Fig-8
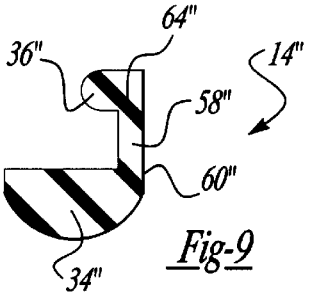
Fig-9
Fig-10
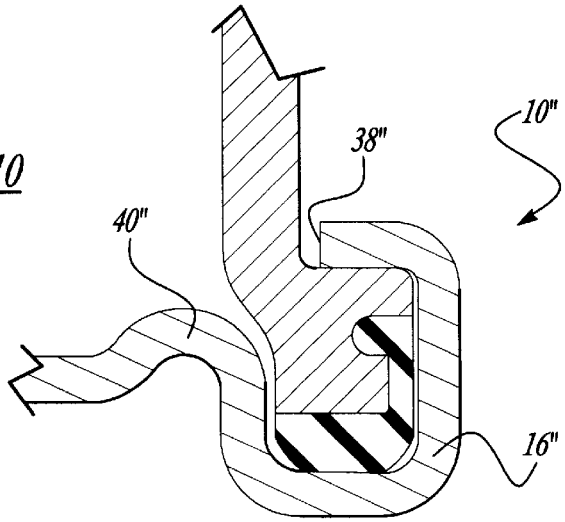

JOINT FOR A HEAT EXCHANGER ASSEMBLY

FIELD OF THE INVENTION

The present invention relates to an end tank to header joint for a heat exchanger assembly. More particularly the invention relates to a gasket having a unique cross-section that is integrated with an end tank of a heat exchanger assembly.

BACKGROUND OF THE INVENTION

It is known to provide heat exchanger assemblies that incorporate a metallic header and a plastic end tank with a gasket being disposed therebetween to provide a fluid-tight seal at the end tank-to-header joint. Known gaskets are not secured to either the header or the end tank but rather the gasket is placed in the header where it is not accurately positioned. This technique is disadvantageous. The gasket will only provide a fluid-tight seal if the gasket is properly positioned on the end tank. The process of mechanically attaching the gasket to the surface of the header may result in misalignment of the gasket, thereby causing defective assemblies that have to be either reassembled or scrapped.

To overcome the disadvantages of not securing the gasket, one known tank-to-header joint employs a gasket that is adhered to the end tank by means of a molding technique. In joints of this type, the end tank is formed with a slot that has deformable projections along the sides of the slot. The gasket is then molded directly to the end tank, the molding process forcing the gasket material to deform the projections such that the projections serve as retaining members for keeping the gasket attached to the end tank. This method is costly and complicated. Therefore, there exists a need for a simple and economically advantageous method of forming the end tank-to-header joint wherein the gasket is integrated with end tank while maintaining the proper alignment of the end tank, gasket and header.

SUMMARY OF THE INVENTION

The present invention is directed to an improved end tank-to-header joint in a heat exchanger. The joint includes three components, an end tank, a gasket and a header. The end tank has a leg, an ankle and a foot, wherein the ankle serves to offset the foot from the leg, thereby forming a flange for the end tank. Disposed within the foot is a least one groove. In the preferred embodiment, the groove is positioned within the bottom of the foot.

The gasket has a base portion and a tongue portion. The tongue portion extends from the base portion and is adapted to engage the groove in the foot to integrate the gasket with the end tank without requiring adhesive or molding techniques. Preferably, the tongue portion has a width that is slightly larger than the width of the groove so as to provide an interference fit. Further, the groove preferably has a variable width dimension so as to form a series of bumps in the groove at regular intervals. The bumps serve to further insure that the tongue is retained within the groove.

The header is crimped so as to form an arcuate portion that is positioned adjacent to the ankle to properly align the header and end tank. The header further includes a channel that generally to corresponds to the shape of the base portion of the gasket such that when the joint is fully assembled, the gasket is fully seated and aligned within the channel. The crimping of the header compresses the gasket between a top surface of the header and the bottom surface of the foot. A distal end of the header is folded onto the top surface of the foot, thereby ensuring that a fluid-tight seal is formed at the joint. By forming the channel in a shape that generally corresponds to the shape of the gasket, proper assembly is ensured, thus reducing the likelihood of reassembly or scrapped components.

Alternative embodiments of the invention are also disclosed. In the alternative embodiments, the gasket is shown as having particular cross-sections that cooperate with the configurations of the foot such that the gasket is properly aligned and integrated with the end tank in a cost effective manner without requiring adhesive or molding techniques.

BRIEF DESCRIPTION OF THE DRAWINGS

The features and inventive aspects of the present invention will become more apparent upon reading the following detailed description, claims, and drawings, of which the following is a brief description:

FIG. 6 is a cross-section of a first alternative embodiment of the gasket;

FIG. 7 is a cross-sectional view of the assembled first alternative embodiment of the end tank-to-header joint in accordance with the present invention;

FIG. 8 is a cross-sectional view of a second alternative embodiment of the end tank;

FIG. 9 is a cross-sectional view of a second alternative embodiment of the gasket; and FIG. 10 is a cross-sectional view of the assembled second alternative embodiment of the end tank-to-header joint in accordance with the present invention.

DETAILED DESCRIPTION OF PREFERRED EMBODIMENTS

Figure 1:
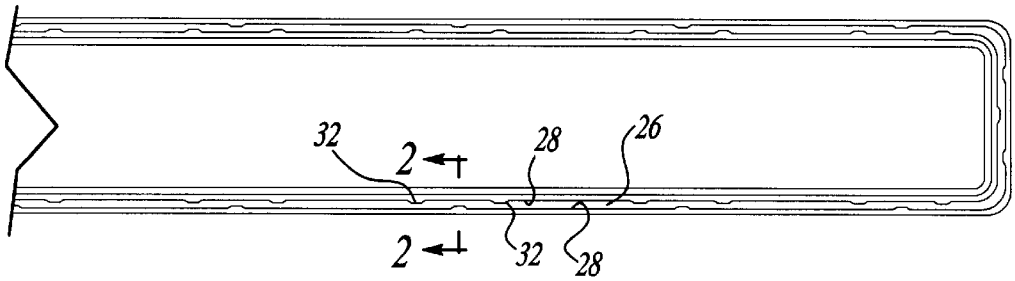
FIG. 1 is a bottom view of an end tank in accordance with the present invention.
Figure 2:
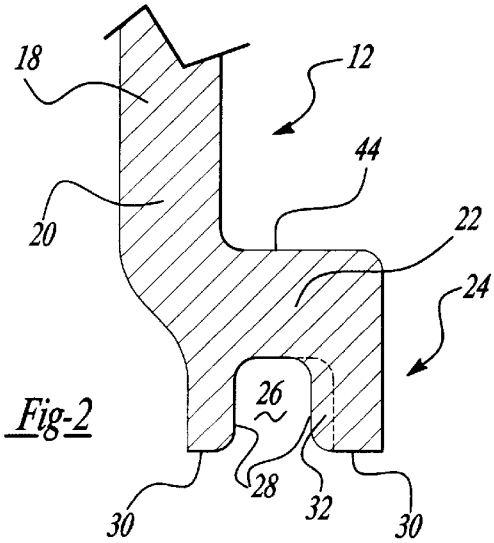
FIG. 2 is a cross-sectional view of the end tank taken along lines 2—2 in FIG. 1.
Figure 3:
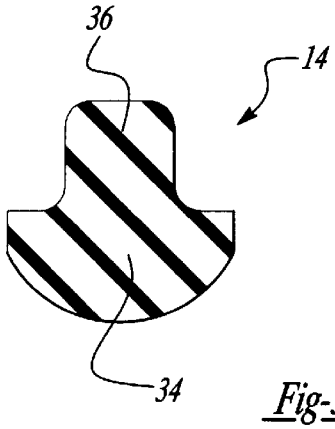
FIG. 3 is a cross-section of a gasket.

FIGS. 1–4 illustrate a preferred embodiment of an improved end tank-to-header joint 10 in a heat exchanger assembly. Joint 10 includes three components, an end tank 12, a gasket 14, and a header 16. End tank 12 has a leg 18, an ankle 20, and a foot 22. Ankle 20 connects leg 18 and foot 22 and serves to offset foot 22 from leg 18. Leg 18 forms a wall of end tank 12, while ankle 20 and foot 22 form a flange 24. Foot 22 includes a groove 26 formed from opposing sidewalls 28. Groove 26 is disposed within a bottom surface 30 of foot 22. In the preferred embodiment, groove 26 has a variable width dimension such that sidewalls 28 form a series of bumps 32 in groove 26, as seen in FIG. 1. Bumps 32 are arranged in an alternating manner such that bumps 32 on opposing sidewalls 28 are not in alignment with one another. Bumps 32 reduce the width of groove 26 to integrate gasket 14 with end tank 12, as discussed below in greater detail. End tank 12 is constructed of plastic or other suitable material such that end tank 12 is cost-efficient to manufacture, while maintaining durability.

Gasket 14 is formed from an elastomeric material or any other suitable material. In one preferred embodiment, gasket 14 has an inverted mushroom shape with a semi-circular base portion 34 and an upwardly projecting generally rectangular tongue 36. Tongue 36 selectively engages groove 26, thereby integrating gasket 14 with end tank 12. Preferably, tongue 36 has a width that is approximately equal to or slightly larger than the width of groove 26 such that an interference fit is produced and tongue 36 is firmly retained within groove 26 without requiring adhesive or a molding step. Bumps 32 of groove 26 further aid in the retention of tongue 36 by compressing tongue 36 within groove 26. Preferably, bumps 32 are arranged in an alternating manner such that bumps are disposed on either side of groove 26 and are not in alignment with one another, thereby insuring that tongue 36 is fully retained within groove 26.

Figure 4:
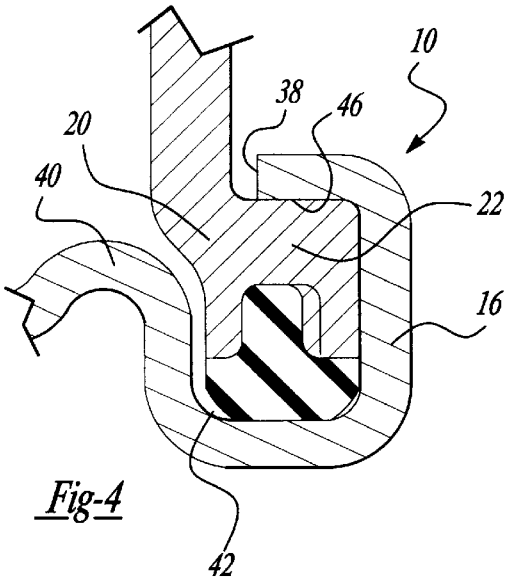
FIG. 4 is a cross-section of an assembled end tank-to-header joint in accordance with the present invention.

To complete joint 10, header 16 is crimped inward from a distal end 38, so as to form an arcuate portion 40. Arcuate portion 40 is positioned adjacent to ankle 20, as seen in FIG. 4 to ensure proper alignment of the header 16 and end tank 12. Header 16 is then crimped again, thereby forming a somewhat U-shaped channel 42 which has a shape that generally corresponds to base portion 34 of gasket 14. As header 16 is crimped around gasket 14, gasket 14 is compressed between header 16 and foot 22. Distal end 38 is then folded over onto a top surface 44 of foot 22 such that a top surface 46 of header 16 abuts top surface 44 of foot 22 in facing relation. Thus, foot 22 and gasket 14 are fully captured within header 16. The corresponding shapes of base portion 34 and channel 42 insure that joint 10 is fluid tight. Header 16 may be formed from aluminum or other suitable material.

By integrating gasket 14 with end tank 12, assembly of joint 10 may be accomplished quickly and easily without requiring the additional steps of adding adhesive to gasket 14 or molding gasket 14 directly to end tank 12. However, groove 26 may be provided with adhesive, to further aid in the retention of tongue 36 of gasket 14.

Figure 5:
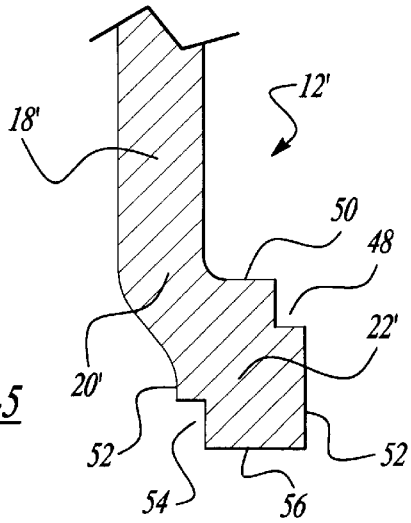
FIG. 5 is a cross-section of a first alternative embodiment of the end tank.

FIGS. 5–7 illustrate an alternative embodiment of joint 10'. End tank 12' is similar to end tank 12 in that it is formed with a leg 18', an ankle 20' and a foot 22'. However, instead of a single groove 26, foot 22' is provided with two grooves, a first groove 48 disposed on a top surface 50 of peripheral edge 52 and a second groove 54 disposed on a bottom surface 56 of peripheral edge 52. Grooves 48 and 54 are approximately of equal size and have a generally rectangular shape, although other shapes are possible as well. Foot 22' has a smaller width relative to the width of foot 22 of joint 10.

Gasket 14' has an L-shape with a base portion 34' and an arm 58. Base portion 34' is similar to base portion 34 of gasket 14 in that both are semi-circular shaped. An arm 58 extends upward from a peripheral edge 60 of base portion 34' and includes a first tongue 62 extending laterally from a top portion 64. First tongue 62 corresponds to the shape and size as first groove 48. A second tongue 66 extends upward from a peripheral edge 68 of base portion 34. Second tongue 66 is sized to correspond to the shape and size of second groove 54.

Header 16' is identical to header 16 in that header 16' is crimped to form arcuate portion 40' and channel 42', and distal end 38' is folded over foot 22' and gasket 14' to form joint 10'. Joint 10' differs from joint 10 in that gasket 14' extends substantially around the peripheral edge 52 of foot 22', thereby insuring a fluid-tight seal all along the periphery of foot 22'.

A third embodiment is illustrated in FIGS. 8–10. Like joints 10 and 10', joint 10" has an end tank 12", a gasket 14" and a header 16". Foot 22" of end tank 12" is provided with a top section 70 and a bottom section 72, wherein a peripheral edge 73 of bottom section 72 is offset a distance $d_1$ from a peripheral edge 72 of top section 70. Foot 22" is provided with a groove 74 that is disposed on the peripheral edge 52" of foot 22" between top section 70 and bottom section 72. As shown in FIG. 8, groove 74 has an elliptical shape, although other shaped grooves maybe used.

Gasket 14", as shown in FIG. 9, is also provided with a semi circular base portion 34". An arm 58" extends upward from a peripheral edge 60" of base portion 34" and includes a tongue 36" extending laterally from a top portion 64". Tongue 36" selectively engages groove 74 to integrate gasket 14" with end tank 12" in a quick, cost effective manner.

To form joint 10", header 16" is crimped around integrated end tank 12" and gasket 14", in a similar manner as in joints 10 and 10' such that arcuate portion 40" is positioned adjacent to ankle 20", channel 42" compresses gasket 14" and distal end 38" is folded onto top surface 44" of foot 22". Thus, a fluid-tight seal is formed at joint 10" with relative ease and without a requirement of an adhesive or a molding step.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. An improved end tank-to-header joint, comprising:

an end tank having a leg, an ankle and a foot, said ankle being disposed between said leg and said foot, said foot having at least one groove defined by opposing sidewalls, wherein a width dimension of said groove is varied such that said sidewalls form bumps within said groove, said bumps being arranged in an alternating manner such that said bumps on said opposing sidewalls are not in alignment with one another;

a gasket having a predetermined shape, said gasket including a base portion and at least one tongue portion that selectively engages said at least one groove of said foot to produce an interference fit so as to integrate said gasket and said end tank; and a header that is crimped to form a channel having a shape that generally corresponds to said shape of said base portion of said gasket to compress said gasket between said header and said end tank, said header further having a distal end that is folded over a top surface of said foot thereby encircling said foot and gasket to provide a fluid tight joint.

2. The joint as in claim 1, wherein said groove is formed within a bottom surface of said foot.

3. The joint as in claim 1, wherein said base portion of said gasket has a semi-circular shape such that said gasket is in the shape of an inverted mushroom, wherein said tongue extends upward relative to said base portion.

4. The joint as in claim 1, further including a deposit of adhesive disposed within said groove to said in retaining said gasket.

5. An improved end tank-to-header joint, comprising:

an end tank having a leg, an ankle and a foot, said ankle being disposed between said leg and said foot, said foot having a groove formed by opposing sidewalls, said groove having a variable dimension so as to form bumps within said groove, said bumps being arranged in an alternating manner such that said bumps of opposing sidewalls are not in alignment with one another;

a gasket having a semi-circular shaped base portion and a tongue portion extending from the base portion, said tongue portion selectively engaging said groove of said foot to produce an interference fit wherein said bumps aid in retaining said tongue portion in said groove to integrate said gasket and said end tank; and a header that is crimped to form an arcuate portion and a generally U-shaped channel, said arcuate portion aligns said header and said end tank, said channel generally corresponds to said semi-circular shaped base portion of said gasket to compress said gasket between said header and said end tank, a distal end of said header is folded over a top surface of said foot thereby encircling said foot and gasket to provide a fluid tight joint.

6. The joint of claim 5, further including a deposit of adhesive disposed within said groove to aid in retaining said gasket.

* * * * *